US009243840B1

(12) United States Patent
Kelly

(10) Patent No.: US 9,243,840 B1
(45) Date of Patent: Jan. 26, 2016

(54) REFRIGERATOR DRAWER WITH SWIVEL SUPPORT FOR REMOVABLE BINS

(71) Applicant: Electrolux Home Products, Inc., Charlotte, NC (US)

(72) Inventor: Paul H. Kelly, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/479,704

(22) Filed: Sep. 8, 2014

(51) Int. Cl.
*F25D 25/02* (2006.01)
*A47B 88/06* (2006.01)

(52) U.S. Cl.
CPC ..... *F25D 25/025* (2013.01); *A47B 88/06* (2013.01)

(58) Field of Classification Search
CPC ..... A47B 88/06; F25D 25/025
USPC ..... 312/301–303, 308, 402, 404, 408; 108/94, 95, 103, 104, 139; 211/115
See application file for complete search history.

(56) References Cited

U.S. PATENT DOCUMENTS

| | | | | |
|---|---|---|---|---|
| 2,058,002 | A | 10/1936 | Daum | |
| 2,468,662 | A * | 4/1949 | Glendening et al. | 312/302 |
| 2,724,629 | A | 11/1955 | Atchison | |
| 2,746,830 | A | 5/1956 | Fonda et al. | |
| 2,754,166 | A | 7/1956 | Ohm | |
| 4,191,437 | A * | 3/1980 | Funke | 312/305 |
| 4,762,237 | A | 8/1988 | Newton | |
| 4,775,201 | A | 10/1988 | Thomson | |
| 5,299,863 | A * | 4/1994 | Albright, Jr. | 312/404 |
| 6,811,235 | B1 | 11/2004 | Brunette | |

* cited by examiner

*Primary Examiner* — Matthew Ing
(74) *Attorney, Agent, or Firm* — Pearne & Gordon LLP

(57) ABSTRACT

A storage assembly is provided for the storage and easy access of goods within a refrigerator cabinet. The refrigerator cabinet includes a top wall, a bottom wall, a back wall, and opposed side walls. The storage assembly comprises a drawer, a swivel mechanism, and at least one bin. The drawer is supported by the side walls of the cabinet and is configured to extend outwardly relative to the back wall of the cabinet. The swivel mechanism is attached to the drawer and comprises a support member that is rotatable relative to the drawer. The at least one bin slidably supported by the support member.

20 Claims, 5 Drawing Sheets

REFRIGERATOR DRAWER WITH SWIVEL SUPPORT FOR REMOVABLE BINS

CROSS-REFERENCE TO RELATED APPLICATIONS

Not applicable.

BACKGROUND OF THE INVENTION

1. Field of Invention

The present application relates generally to a storage assembly for a refrigerator, and more specifically, to a storage assembly with a full extension drawer and a swivel mechanism including a support member, wherein rotation of the support member relative to the drawer provides access to sliding bins on opposite sides of the support member.

2. Description of Related Art

Generally, a refrigerator is an electrical appliance that keeps food fresh in a storage compartment for a long time by maintaining an interior temperature thereof to be lower than an exterior temperature. The storage compartment is defined by a main body of the refrigerator. The refrigerator generates cool air as a refrigerant circulates a cooling cycle and supplies the cool air to the storage compartment to maintain the food in the storage compartment at a predetermined low temperature.

Often, a refrigerator will have multiple storage compartments. For example, a refrigerator may include both a fresh food compartment and a freezer compartment. The fresh food compartment is where food items such as fruits, vegetables, and beverages are stored and the freezer compartment is where food items that are to be kept in a frozen condition are stored. In some cases, the freezer compartment and the fresh food compartment will be vertically aligned, with one compartment above the other.

The necessarily compact interiors of the storage compartments inherently give rise to problems with regard to utilization of limited interior space and convenient access to stored items or goods. Further, in view of the conventional manner of stacking goods on and in relatively deep shelves and bins, it is not unusual for a user of the refrigerator to have to remove or displace several items in order to obtain access to a particular item.

Typically, storage bins are placed below a stationary shelf in the cabinet of a refrigerator for placement and storage of a variety of goods and items. The bins are pulled out by a user from a closed position to an open position for access to a particular item. The particular item may be buried or placed in the back of the bin, making it difficult for a user to access the particular item. For a variety of reasons, including aesthetics, the desirability of taking up as little as space as possible in the interior of the refrigerator and the ease of accessibility to goods and items within the storage bins is of concern.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

According to one aspect, the subject application involves a refrigerator comprising an insulated cabinet; a drawer slidably supported in the cabinet; a bin; and a support assembly connected to the drawer and the bin, the support including a swivel mechanism permitting the bin to be rotated relative to the drawer. The drawer is slidable on a first axis the bin is rotatable on a second axis different from the first axis. The bin is slidable relative to the drawer on an axis parallel to the first axis. The drawer is slidable on a horizontal axis the bin is rotatable on a vertical axis. The bin is slidable relative to the drawer on a horizontal axis. The support assembly is connected to the drawer such that the bin moves with the drawer when the drawer is slidably moved. A second bin is connected to the drawer by the support assembly. The bin and second bin are attached to the support mechanism such that the bin can be rotated to a position below a front part of the drawer allowing access to the bin while the second bin is rotated to a position below a rear part of the drawer. The bin and the second bin are slidable relative to the drawer on a generally horizontal axis. The bin and the second bin are separately removable from the support assembly. The at least one bin comprises a lid to seal the bin. The drawer includes drawer slides supporting a drawer compartment, wherein the support assembly includes a support plate attached to the drawer slides and a support member rotatably attached to the support plate by the swivel mechanism. The support plate comprises at least one arm protruding from a surface of the support plate for receiving at least one pin and at least one roller. The support member comprises a circular track and the at least one roller is configured to engage and roll around the track to allow rotation of the support member. The support member is rotatable relative to the support plate, and the drawer and the support plate are stationary while the support member rotates.

According to another aspect, the subject application involves a storage assembly for a refrigerator comprising a drawer having a slide mechanism for slidably attaching the drawer to the refrigerator; a bin; and a support assembly connected to the drawer and the bin, the support including a swivel mechanism permitting the bin to be rotated relative to the drawer. The storage assembly also includes a support plate configured to support the drawer and a support member rotatably attached to the support plate and configures to slidingly support the bin. The support member is adapted to rotate three hundred and sixty degrees about the axis. The at least one bin comprises two, three, and/or four bins.

According to yet another aspect, the subject application involves a storage assembly for a refrigerator cabinet comprising a top wall, a bottom wall, a back wall, and a pair of opposed side walls extending between the bottom and top wall. The storage assembly includes a drawer supported by the side walls and configured to be slid away from the back wall of the cabinet to provide access to items stored in the drawer; a swivel mechanism attached to the drawer and comprising a support plate stationary relative to the drawer and a support member rotatable relative to the support plate and the drawer; at least one bin slidably supported by and rotatable with the support member, wherein the at least one bin comprises at least one projection on one sidewall of the bin and another projection on an opposing sidewall of the bin, wherein the projections project outwardly from the opposing side walls of the bin and are configured to engage at least one inwardly extending flange of the support member to support the bin, wherein the bin is positioned such that the bin can be rotated with the support member to a position in which the bin can be slid away from the back wall of the cabinet to provide access to items stored in the bin.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION

Figure 1:
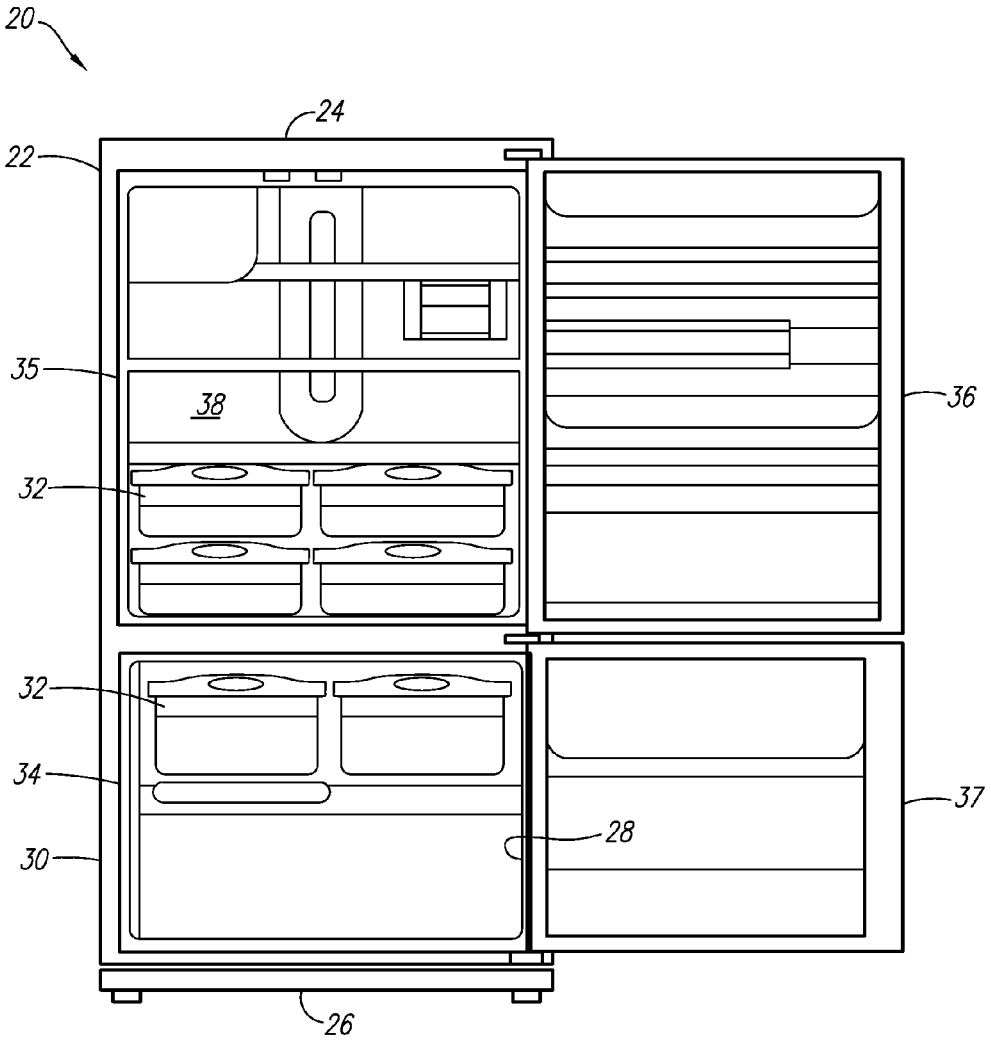
FIG. 1 shows a front view of an embodiment of a refrigerator having a fresh food compartment and freezer compartment.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Referring to FIG. 1, there is illustrated a refrigeration appliance in the form of a domestic refrigerator, indicated generally at 20. The refrigerator 20 comprises a cabinet 22 having a top wall 24, a bottom wall 26, and a pair of opposed side walls 28, 30 extending normally from and between the bottom wall 26 and top wall 24. The cabinet further comprises a back wall 38 extending normally from and between the bottom wall 26 and top wall 24. The refrigerator 20 includes a freezer compartment 34 vertically disposed below a fresh-food compartment 35. Each compartment 34, 35 may be provided with a storage assembly 32 for storage of goods and items. Additionally, doors 36, 37 are provided to provide access to each compartment 34, 35.

Although FIG. 1 shows a refrigerator 20 which includes a freezer compartment 34 vertically disposed below a fresh-food compartment 35, the compartments 34, 35 may be arranged according to other configurations. For example, the fresh-food compartment 35 may be vertically disposed below the freezer compartment 34 or the two compartments 34, 35 may be side by side. Alternatively, the refrigerator 20 may only have a single compartment. The refrigerator 20 can have any desired configuration including a cabinet and a door without departing from the scope of the invention.

Figure 2:
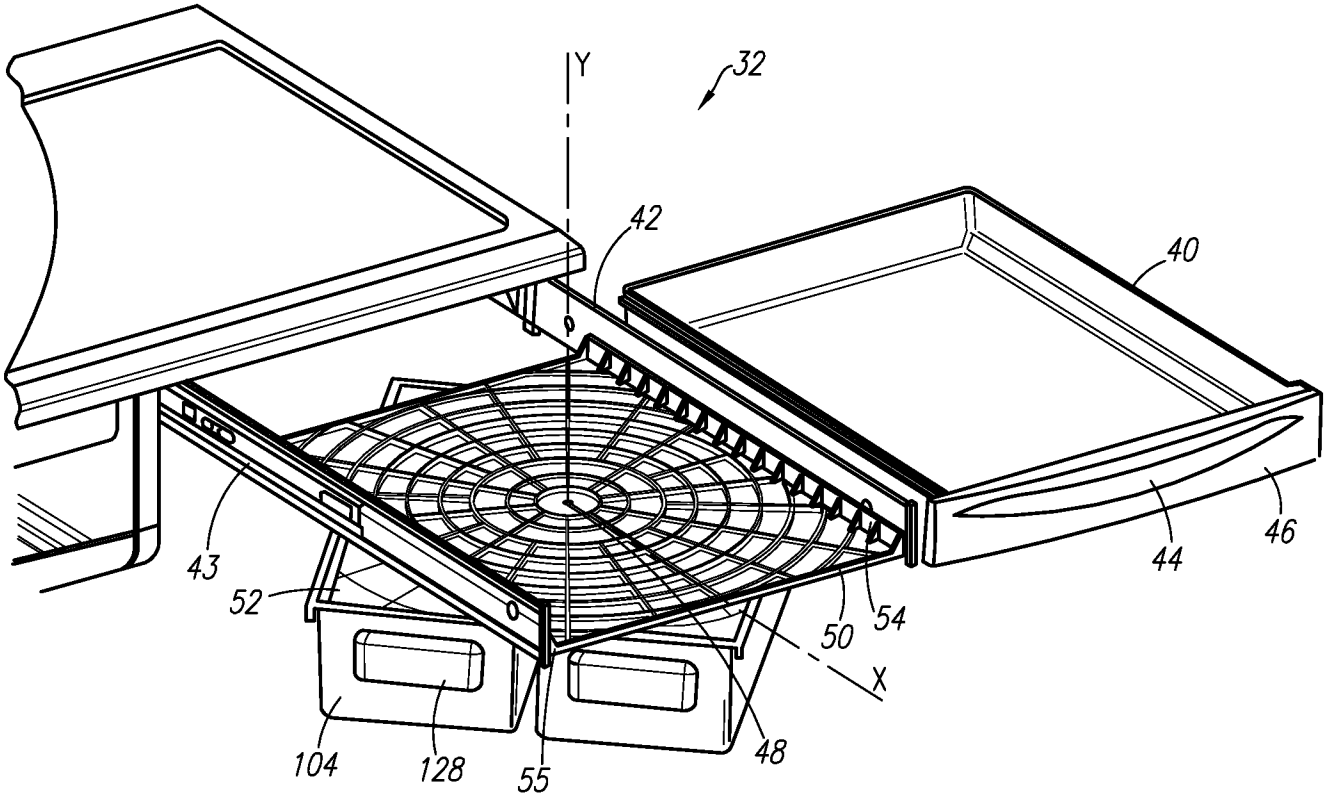
FIG. 2 shows a partially disassembled view of a configuration for the storage assembly.

FIG. 2 shows a perspective view of a storage assembly 32 that may be installed into the cabinet 22 of the refrigerator 20 for storage of goods and items. The storage assembly 32 comprises a drawer 40 that is supported by the side walls 28, 30. The drawer may be placed on sliding support rails 42, 43 that may be attached to the side walls 28, 30 using screws, bolts, or any other fastening means. When the drawer 40 is placed on the sliding support rails 42, 43, the storage assembly 32 may be configured to extend outwardly relative to the back wall 38. The drawer 40 may include a handle 44 on a front face 46 of the drawer 40 that allows a user to extend the storage assembly 32 outwardly relative to the back wall 38. The handle 44 may be molded onto the front face 46 of the drawer 40 or may be attached using screws, bolts, or any other fastening means. Additionally, the molded handle may allow a user to lift the drawer 40 out of the storage assembly 32 completely such that the drawer 40 may be selectively removable, as shown in FIG. 2. In other configurations, the drawer 40 is non-removable and a fixed part of the storage assembly 32.

In addition to the drawer 40, the storage assembly 32 in the present embodiment comprises a swivel mechanism 48. The swivel mechanism 48 may be integral with the drawer 40 or it may be a separate component that is attached to the drawer 40. The swivel mechanism 48 in the present example is separate from the drawer 40 and comprises a support plate 50 and a support member 52. The support plate 50 is configured to support the drawer 40 when the drawer 40 is positioned within and not removed from the storage assembly 32. The support plate 50 may be substantially rectangular and may include upwardly extending opposed side walls 54, 55. The upwardly extending side walls 54, 55 may be configured to be secured to the support rails 42, 43 by adhesive means, screws, bolts, or any other fastening means. However, in other configurations, the support plate 50 may be directly affixed or may be integral to the drawer 40 and may be oval-shaped.

Figure 3A:
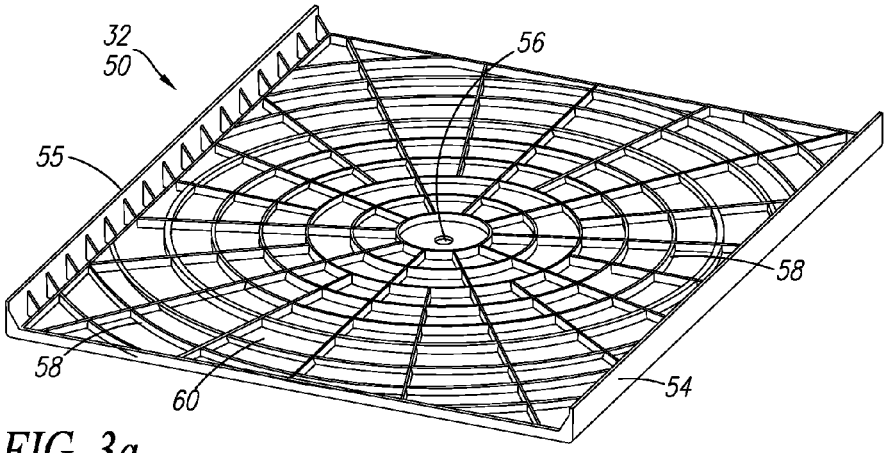
FIG. 3*a* shows a configuration of the top side of the support plate.
Figure 3B:
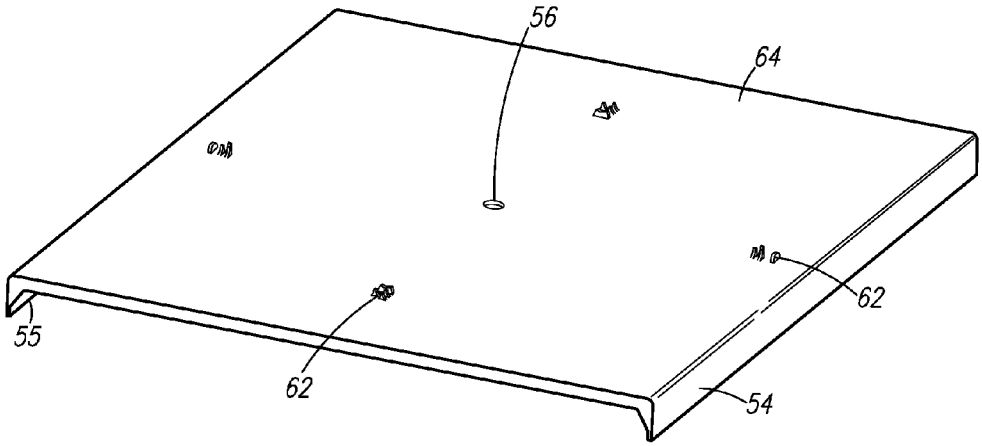
FIG. 3*b* shows a configuration of the bottom side of the support plate.

As shown in FIGS. 3*a* and 3*b*, the support plate 50 may include at least one aperture 56 that is centrally located on the support plate 50. Additionally, ribs 58 may be provided in a spider-web orientation on the top surface 60 of the support plate 50. The ribs 58 may be formed relative to the aperture 56 and extend away from the aperture 56 towards each edge of the support plate 50. The ribs 58 can provide the support plate 50 with increased yield strength, shear strength, and tensile strength when a transverse loading, an axial loading, or torsional loading is applied to the support plate 50. Although the ribs 58 are arranged in a spider-web orientation along the top surface 60 of the support plate 50 in FIG. 3*a*, there may be other configurations of the storage assembly 32 wherein the support plate 50 has a different rib orientation. For example, the ribs 58 may be parallel to one another or have a checkerboard orientation to provide the support plate 50 with increased strength characteristics. Furthermore, in alternative configurations, the support plate 50 may have a substantially flat top surface 60 without the aperture 56.

Figure 4:
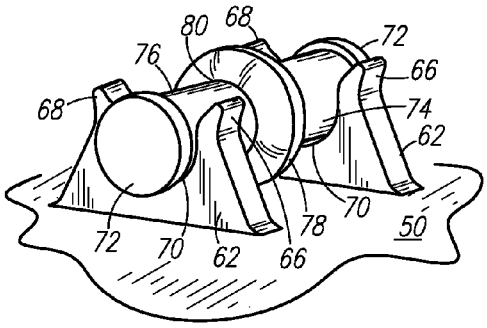
FIG. 4 shows a configuration of a pair of retaining arms and a pin and a roller on the support plate.

Additionally, the support plate 50 may include a plurality of pairs of retaining arms 62 protruding outwardly relative to the bottom surface 64 of the support plate. Referring to FIG. 4, each retaining arm 62 may include a first finger 66, a second finger 68, and an engaging portion 70, wherein each retaining arm 62 is configured to receive an end 72 of a pin 74. When the engaging portion 70 of each retaining arm 62 receives an end 72 of the pin 74, the first finger 66 and second finger 68 of each retaining arm 62 may deflect momentarily and outwardly relative to the engaging portion 70 in order to properly receive and retain the pin 74 in the engaging portion 70. Each pin 74 may have a substantially cylindrical body portion 76 wherein each end 72 has a slightly larger diameter than the body portion 76 to secure the pin 74 in the engaging portion 70 of each retaining arm 62. Each pin 74 may be press fit or snap fit into the engaging portion 70. Furthermore, a roller 78 may be configured to overlie the pin 74 centrally between the respective ends 72 of the pin 74 and between a pair of the retaining arms 62. The roller 78 is substantially cylindrically-shaped and includes an opening 80 that may be configured to receive either end 72 of the pin 74. Once the roller 78 overlies the pin 74, the ends 72 of the pin 74 may then be press-fit or snap-fit into the engaging portion 70 of each pair of retaining arms 62. As shown in FIG. 3*b*, there may be four pairs of retaining arms 62 spaced equidistant from the aperture 56 and towards each edge of the support plate 50. Although FIG. 3*b* shows four pairs of retaining arms 62 that are configured to receive a pin 74 and roller 78 and are spaced apart at equidistant positions relative to the aperture 56, the retaining arms 62 may be arranged according to other configurations. For example, there may be provided additional retaining arms 62 configured to receive a pin 74 and roller 78. Alternatively, there may be less than four retaining arms 62.

Figure 5A:
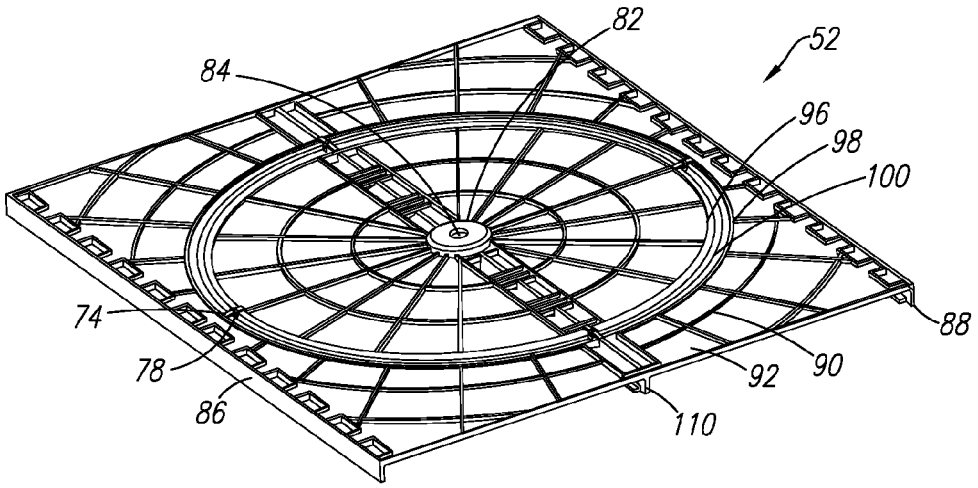
FIG. 5*a* shows a configuration of the top side of the support member.
Figure 5B:
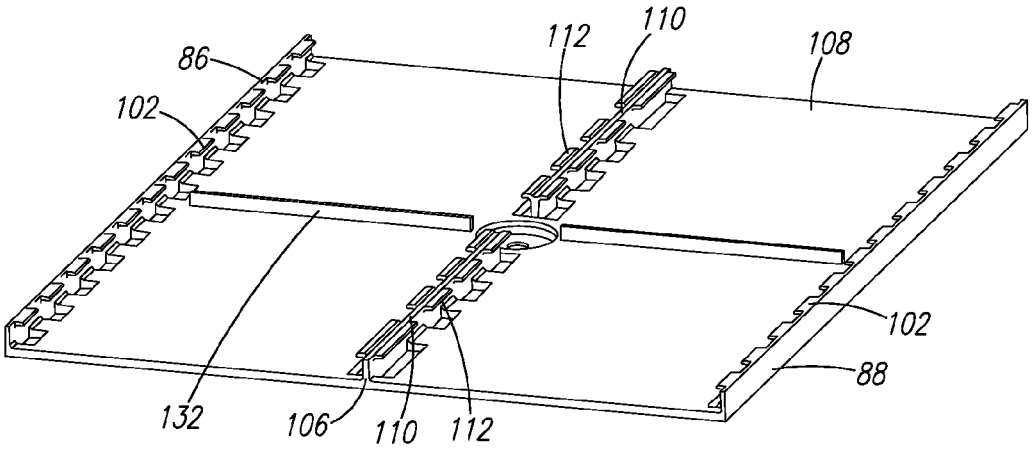
FIG. 5*b* shows a configuration of the bottom side of the support member.

Referring to FIGS. 5*a* and 5*b*, the support member 52 may comprise a central hub 82 including an aperture 84 that is centrally located on the support member 52. The central hub 82 and aperture 84 may be configured to align with the aperture 56 of the support plate 50 for attachment purposes. The support member 52 may be substantially rectangular and may include downwardly extending opposed side walls 86, 88. Additionally, ribs 90 may be provided in a spider-web orientation on the top surface 92 of the support member 52. The ribs 90 may be formed relative to the aperture 84 and extend away from the aperture 84 towards each edge of the support member 52. The ribs 90 can provide the support member 52 with increased yield strength, shear strength, and tensile strength when a transverse loading, an axial loading, or torsional loading is applied to the support member 52. Although the ribs 90 are arranged in a spider-web orientation along the top surface 92 of the support member 52, there may be other configurations of the storage assembly 32 wherein the support member 52 has a different rib orientation. For example, the ribs 90 may be parallel to one another or have a checkerboard orientation to provide the support member 52 with increased strength characteristics. Furthermore, in alternative configurations, the support member 52 may have a substantially flat top surface 92 without the aperture 84.

Additionally, the support member 52 comprises a circular track 94 that surrounds the central hub 82 and an aperture 84 of the support member 52 and is defined by the pin 74 and roller 78 on a front side of the support member 52. The inner and outer edges 96, 98 of the track 94 may be raised relative to the top surface 92 of the support member 52, and the inner and outer edges 96, 98 may be configured to engage a respective end 72 of the pin 74. Furthermore, the interior portion 100 of the track 94 may have a tapered alignment such that each roller 78 can engage the track 94, stay nested in the track 94, and roll around the track 94 as the support member 52 is rotated relative to the drawer 40 and support plate 50.

On the back side of the support member 52, the side walls 86, 88 of the support member 52 comprise an inwardly extending flange portion 102 that may be configured to act as a rail support and to receive one side of a bin 104. The middle portion 106 of the bottom surface 108 of the support member 52 may also be provided with a rail 110 including a flange portion 112 that may be configured to receive and support an opposite side of a bin 104. The flange portion 102 extending from the side walls 86, 88 and the flange portion 112 of the rail 110 may be molded onto the side walls 86, 88 and the rail 110. Alternatively, the rail 110 may be attached to the bottom surface 108 of the support member 52 by adhesive means, screws, bolts, or any other fastening means.

Figure 6:
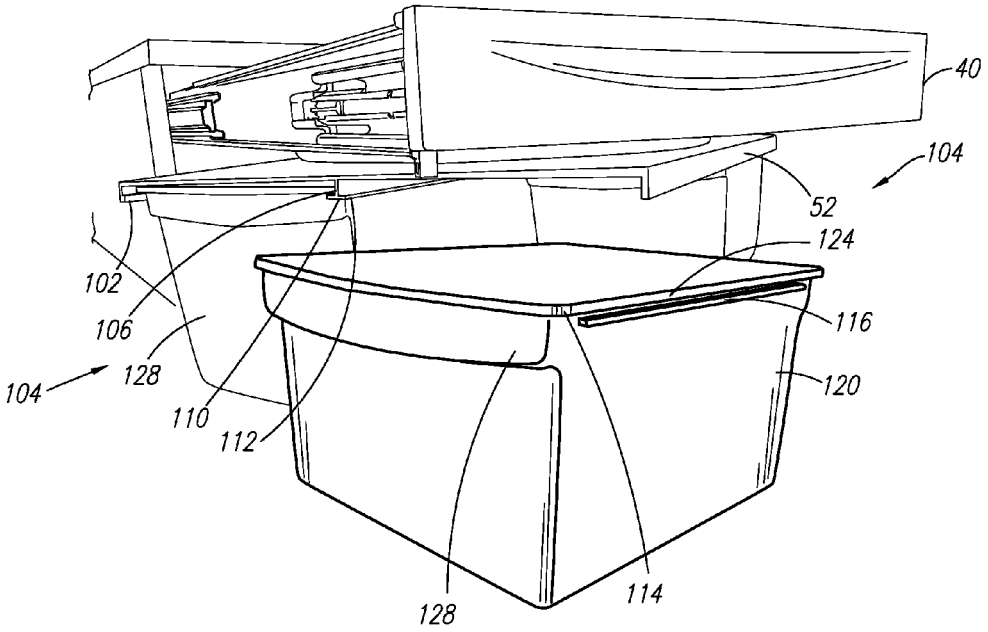
FIG. 6 shows a configuration of a storage bin for the storage assembly.

Referring to FIG. 6, the storage assembly 32 further comprises at least one bin 104 configured to store goods and items in the fresh-food and freezer compartments 34, 35. The at least one storage bin comprises a removable lid 114 to seal the bin 104 in order to keep the goods that are stored within the bin 104 fresh. The at least one bin 104 may include first and second projections 116, 118 on opposing sidewalls 120, 122 of the bin 104. The first projection 116 may be configured to slidably engage the inwardly extending flange portion 102 of the downwardly extending opposed side walls 86, 88 of the support member 52 to support the bin 104. The second projection 118 may also be configured to slidably engage the flange portion 112 of the rail 110 of the support member 52 to support the bin 104. Alternatively, the lid 114 may be configured to engage the inwardly extending flange portion 102 of the sidewalls 86, 88 and the flange portion 112 of the rail 110. For example, opposing sides 124, 126 of the lid 114 may extend beyond the walls of the bin 104 such that the sides 124, 126 of the lid 114 can slidably engage the flange portion 102 of the sidewalls 86, 88 and flange portion 112 of the rail 110. Furthermore, the at least one bin 104 may include a molded handle 128 on a front face 130 of the bin 104, wherein a user can pull the handle 128 to slide the bin 104 from the support member 52 and remove the bin 104 from the storage assembly 32. The at least one bin 104 can comprise two, three, or four bins depending on user preference. The bin 104 may be of various sizes that are adapted to slidably engage the support member 52. For example, one bin may be provided on one half of the support member 52, while one bin is provided on the other half of the support member 52. Alternatively, two bins may be proved one half of the support member 52, while two bins may also be provided on the other half of the support member 52. Alternatively, two bins may be proved one half of the support member 52, while one bin may be provided on the other half of the support member 52. Alternatively, only one bin may be provided on the support member 52. Moreover, as shown in FIG. 5*b*, the support member 52 may further include at least one divider 132 to prohibit sliding of the at least one bin 104 beyond a certain point, and to divide the bottom surface 108 of the support member 52 into distinct storage regions. The divider 132 may be molded onto the bottom surface 108 of the support member 52 or may be attached to the bottom surface 108 of the support member 52 by adhesive means, screws, bolts, or any other fastening means.

Figure 7:
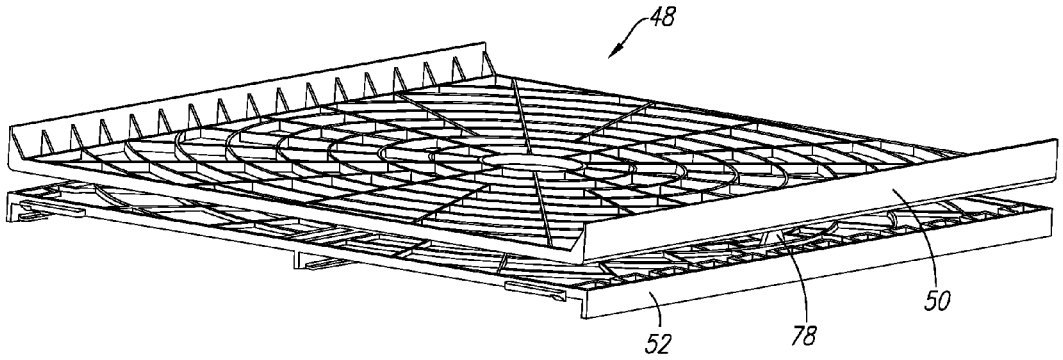
FIG. 7 shows a configuration of the swivel mechanism of the storage assembly, wherein the swivel mechanism comprises the support plate and the support member.

Referring now to FIG. 7, the support plate 50 and the support member 52 are combined and attached together to create the swivel mechanism 48. The support plate 50 and the support member 52 may be secured together by press-fitting or snap-fitting. The retaining arms 62 in combination with the pin 74 and roller 78 may engage and snap into the track 94, thereby connecting the support plate 50 and support member 52. In other configurations, the support plate 50 may comprise a molded male portion and the support member 52 may comprise a molded female portion. Once the male portion engages the female portion, a pin or other mechanism may slide through the male and female portion to secure the support plate 50 and support member 52 together. Alternatively, for example, the support plate 50 may comprise a threaded aperture and the support member 52 may comprise a threaded portion, such that the threaded portion can be threadably inserted into the threaded aperture to secure the support member 52 to the support plate 50. When the support plate 50 and the support member 52 are attached to one another, the support plate 50 and the support member 52 may be slightly separated by the outer surface of the roller 78. Thus, the clearance between the support plate 50 and the support member 52 may vary depending on the circumference and diameter of the roller 78 selected to engage the track 94 on the support member 52. For example, the clearance between the support plate 50 and the support member 52 may be in a range of about a tenth of an inch to approximately 2 inches.

Referring back to FIGS. 1 and 2, the operation of the storage assembly 32 will now be described. A user may apply a force and pull on the handle 44 of the drawer 40 to extend the storage assembly 32 from its resting position inside either compartment 34, 35 to its fully extended position outside of the cabinet 22. For ease of access to a back portion of one of the bins 104, the swivel mechanism 48 may define an axis Y about which the support member 52 can rotate, wherein the support member 52 is adapted to rotate three hundred and sixty degrees about the axis Y. The axis Y can be generally vertical. That is, the axis Y is arranged such that, when more than one bin is supported by the swivel mechanism, one bin can be rotated to a position below a front part of the drawer allowing access to the bin while another bin is rotated to a position below a rear part of the drawer. The support member 52 of the swivel mechanism 48 is rotatable relative to the drawer 40 and to the support plate 50, wherein the drawer 40 and the support plate 50 are stationary while the support member 52 rotates. Thus, the drawer 40 and the at least one bin 104 are configured to allow the swivel mechanism 48 to rotate, thereby providing access to any portion of any bin 104 on opposite sides of the support member 52.

It should be apparent that the foregoing relates only to certain embodiments of the present application and that numerous changes and modifications may be made herein by one of ordinary skill in the art without departing from the general spirit and scope of the invention as defined by the following claims and equivalents thereof.

What is claimed is:

1. A refrigerator comprising:

an insulated cabinet;

a drawer slidably supported in the cabinet;

a first bin; and a support assembly connected to the drawer and the first bin, the support assembly including a swivel mechanism permitting the first bin to be rotated relative to the drawer.

2. The refrigerator of claim 1, wherein the drawer is slidable on a first axis, and wherein the first bin is rotatable on a second axis different from the first axis.

3. The refrigerator of claim 2, wherein the first bin is slidable relative to the drawer on an axis parallel to the first axis.

4. The refrigerator of claim 1, wherein the drawer is slidable on a horizontal axis and the first bin is rotatable on a vertical axis.

5. The refrigerator of claim 4, wherein the first bin is slidable relative to the drawer on the horizontal axis.

6. The refrigerator of claim 1, wherein the support assembly is connected to the drawer such that the first bin moves with the drawer when the drawer is slidably moved.

7. The refrigerator of claim 1, further comprising a second bin connected to the drawer by the support assembly.

8. The refrigerator of claim 7, wherein the first bin and the second bin are attached to the support assembly such that the bins can be rotated to position the first bin below a front part of the drawer allowing access to the first bin and the second bin to a position below a rear part of the drawer allowing access to the rear bin.

9. The refrigerator of claim 8, wherein the bins are slidable relative to the drawer on a horizontal axis.

10. The refrigerator of claim 8, wherein the first bin and the second bin are separately removable from the support assembly.

11. The storage assembly of claim 1, wherein the first bin comprise a lid to seal the first bin.

12. The refrigerator of claim 1, wherein the support assembly is mounted within the cabinet and supports the drawer and the first bin, the assembly comprising opposed sliding support rails, a support plate, and a support member, the rails being slidably extendable outward relative to the back wall, the support plate being fixed to the rails and comprising a surface extending between the rails, the drawer being removably positioned on the surface of the support plate, the support member being mounted to and positioned underneath the support plate, the first bin being slidably mounted to the support member, the support member and the support plate defining the swivel mechanism to permit the support member to be rotated relative to the support plate.

13. The refrigerator of claim 12, wherein the support plate comprises at least one arm protruding from a surface of the support plate for receiving at least one pin and at least one roller.

14. The storage assembly of claim 13, wherein the support member comprises a circular track, wherein the at least one roller is configured to engage and roll around the track to allow rotation of the support member.

15. The storage assembly of claim 12, wherein the drawer and the support plate are stationary while the support member rotates.

16. A storage assembly for a refrigerator comprising:

a drawer having a slide mechanism for slidably attaching the drawer to the refrigerator;

a first bin; and a support assembly connected to the drawer and the first bin, the support assembly including a swivel mechanism permitting the first bin to be rotated relative to the drawer.

17. The storage assembly of claim 16, wherein the support assembly is mounted within the cabinet and supports the drawer and the first bin, the assembly comprising opposed sliding support rails, a support plate, and a support member, the rails being slidably extendable outward relative to the back wall, the support plate being fixed to the rails and comprising a surface extending between the rails, the drawer being removably positioned on the surface of the support plate, the support member being mounted to and positioned underneath the support plate, the first bin being slidably mounted to the support member, the support member and the support plate defining the swivel mechanism to permit the support member to be rotated relative to the support plate.

18. The storage assembly of claim 17, wherein the support member is adapted to rotate three hundred and sixty degrees about a vertical axis.

19. The storage assembly of claim 16, further comprising two, three, and/or four bins connected to the support assembly and permitted to be rotated relative to the drawer by the swivel mechanism.

20. A storage assembly for a refrigerator cabinet comprising a top wall, a bottom wall, a back wall, and a pair of opposed side walls extending between the bottom and top wall, the storage assembly comprising:

a drawer supported by the side walls and configured to be slid away from the back wall of the cabinet to provide access to items stored in the drawer;

a swivel mechanism attached to the drawer and comprising a support plate stationary relative to the drawer and a support member rotatable relative to the support plate and the drawer; and a first bin slidably supported by and rotatable with the support member, wherein the first bin comprises at least one projection on one sidewall of the first bin and another projection on an opposing sidewall of the first bin, the projections projecting outwardly from the opposing side walls of the first bin and engaging at least one inwardly extending flange of the support member to support the first bin, and wherein the first bin is positioned such that the first bin can be rotated with the support member to a position at which the the first bin can be slid away from the back wall of the cabinet to provide access to items stored in the first bin.

* * * * *